US011745192B2

(12) United States Patent
Arenson et al.

(10) Patent No.: US 11,745,192 B2
(45) Date of Patent: Sep. 5, 2023

(54) WIDE ANGLE SPRAY NOZZLE

(71) Applicant: Spraying Systems Co., Wheaton, IL (US)

(72) Inventors: Marc A. Arenson, Bartlett, IL (US); Daniel J. Cederberg, South Elgin, IL (US)

(73) Assignee: Spraying Systems Co., Wheaton, IL (US)

( * ) Notice: Subject to any disclaimer, the term of this patent is extended or adjusted under 35 U.S.C. 154(b) by 54 days.

(21) Appl. No.: 16/870,558

(22) Filed: May 8, 2020

(65) Prior Publication Data

US 2020/0353485 A1 Nov. 12, 2020

Related U.S. Application Data

(60) Provisional application No. 62/846,055, filed on May 10, 2019.

(51) Int. Cl.

| | |
|---|---|
| ***B05B 1/04*** | (2006.01) |
| ***B05B 1/14*** | (2006.01) |
| ***B05B 1/30*** | (2006.01) |
| ***B05B 7/02*** | (2006.01) |
| ***B05B 7/24*** | (2006.01) |

(52) U.S. Cl.

CPC ..... *B05B 1/044* (2013.01); *B05B 1/14* (2013.01); *B05B 1/30* (2013.01); *B05B 7/02* (2013.01); *B05B 7/2475* (2013.01)

(58) Field of Classification Search

CPC .. B05B 1/044; B05B 1/14; B05B 1/30; B05B 7/02; B05B 7/2475; B05B 1/046

USPC ..... 239/601

See application file for complete search history.

(56) References Cited

U.S. PATENT DOCUMENTS

| | | | | |
|---|---|---|---|---|
| RE9,397 E * | 10/1880 | Sparrow | ..... | B05B 3/02 239/251 |
| 5,316,218 A * | 5/1994 | Bowen | ..... | B05B 13/0636 239/246 |
| 5,921,472 A | 7/1999 | Haruch | | |

(Continued)

OTHER PUBLICATIONS

European Patent Office, International Search Report and Written Opinion in corresponding International Patent Application No. PCT/US2020/032195 dated Jul. 17, 2020 (11 pages).

*Primary Examiner* — Steven M Cernoch

(74) *Attorney, Agent, or Firm* — Leydig, Voit & Mayer, Ltd.

(57) ABSTRACT

A spray nozzle is disclosed that includes a nozzle body having a first portion with a cylindrical configuration and a second portion including a dome-shaped end wall. The first and second portions of the nozzle body define an internal fluid passage having a downstream end defined by the dome-shaped end wall. A flow control element is arranged at an inlet end of the internal fluid passage. The flow control element includes a pre-orifice through which fluid can enter the internal fluid passage of the nozzle body. First and second discharge orifices are provided in the dome-shaped end wall with each of the first and second discharge orifices being arranged on a respective one of opposing sides of an apex of the dome-shaped end wall. The first and second discharge orifices are configured to produce a fan-shaped fluid discharge pattern with each discharge orifice having an elongated slit-like configuration.

16 Claims, 12 Drawing Sheets

(56) References Cited

U.S. PATENT DOCUMENTS

| | | | | |
|---|---|---|---|---|
| 5,975,431 | A * | 11/1999 | Harita | B60S 1/52 15/322 |
| 6,866,211 | B2 * | 3/2005 | Paulsen | B05B 1/046 239/592 |
| 7,854,396 | B2 * | 12/2010 | Wu | A01M 7/0017 239/152 |
| 2006/0186232 | A1 | 8/2006 | Kassanits | |
| 2014/0042251 | A1 * | 2/2014 | Maksymec | B05B 1/3026 239/569 |

* cited by examiner

WIDE ANGLE SPRAY NOZZLE

CROSS-REFERENCE TO RELATED APPLICATIONS

This application claims benefit of U.S. Provisional Application Ser. No. 62/846,055, filed May 10, 2019, entitled "WIDE ANGLE SPRAY NOZZLE," the contents of which are expressly incorporated herein by reference in their entirety, including any references therein.

BACKGROUND OF THE INVENTION

Spray devices have long been used in the agricultural industry for spraying liquids such as pesticides, herbicides and fungicides. One example of such a spray device is a backpack sprayer having a handheld wand that an operator uses to apply agrichemicals to the plants. The wand typically uses a spray nozzle that has a relatively narrow spray angle with a tapered distribution pattern. While inexpensive, this kind of backpack spray device has a number of drawbacks. For example, the nozzle configuration can lead to inconsistent spray coverage of the plants leading to poor efficacy of the treatment. The narrow spray angle can also require an operator to make numerous passes in order to apply the chemicals to a given area. As a result, the chemical application operation can be time consuming and thus more costly.

OBJECTS OF THE INVENTION

In view of the foregoing, a general object of the present invention is to provide a spray nozzle for a spray device that has improved spray coverage leading to a more efficacious application of liquids than achieved with existing sprayers used in agricultural applications.

A related object of the present invention is to provide a spray nozzle for a spray device that produces a relatively wide distribution pattern such that liquids may be applied in a more efficient and less time consuming manner than with existing sprayers used in a agricultural applications.

A further object of the present invention is to provide a spray nozzle for a spray device that produces an even spray distribution.

Another object of the present invention is to provide a spray nozzle for a spray device that can be manufactured at a relatively low cost.

Other objects and advantages of the invention will become apparent upon reading the following detailed description and upon reference to the drawings. The identified objects are not intended to limit the present invention.

DETAILED DESCRIPTION OF THE INVENTION

Figure 1:
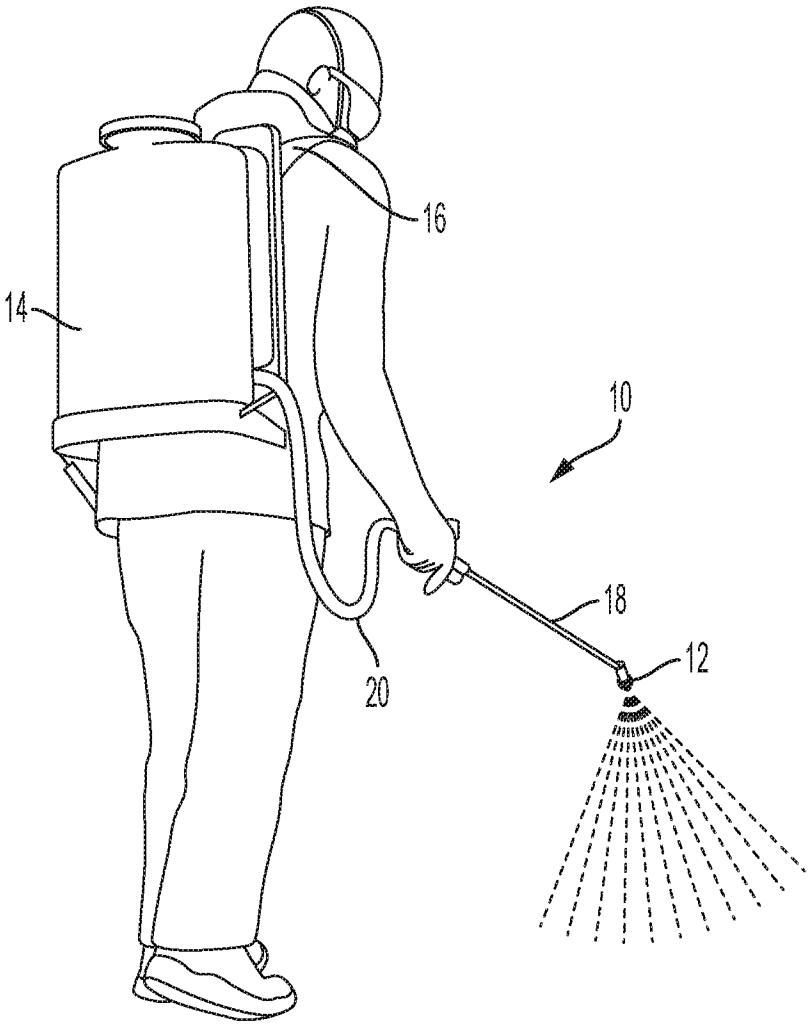
FIG. 1 is a perspective view of an operator using an exemplary backpack spray device having a wand with a spray nozzle according to the teachings of the present invention.
Figure 2:
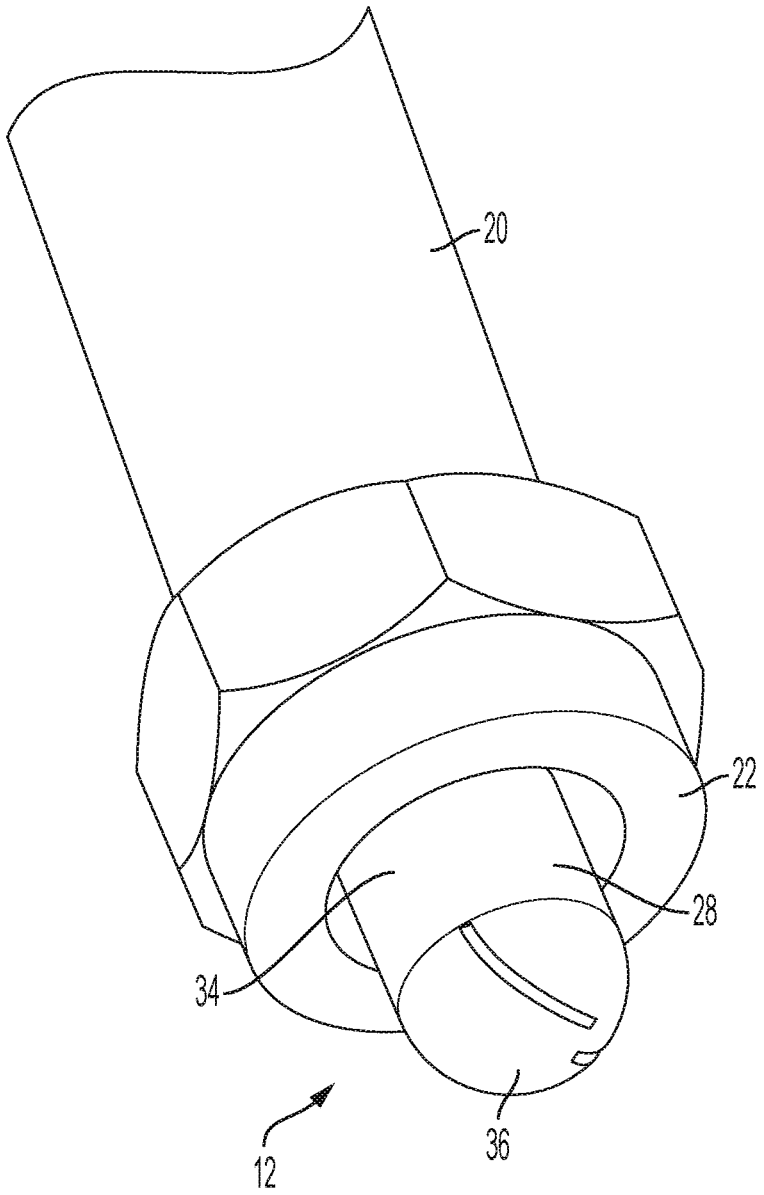
FIG. 2 is a partial perspective view of the wand of the spray device of FIG. 1 showing the spray nozzle.

Referring to FIGS. 1 and 2 of the drawings, there is shown an exemplary embodiment of a spray device 10 having a spray nozzle 12 (best seen in FIG. 2) configured in accordance with the present invention. The illustrated spray device 10 is a backpack sprayer that is particularly suited for discharging chemicals such as pesticides, herbicides and fungicides in agricultural and lawn and garden care environments. However, the present invention is not limited to the spraying of such liquids or use in such environments. Rather, the spray nozzle 12 of the present invention is intended for spraying any suitable liquid in which a wide angle and even distribution pattern may be advantageous. Moreover, the spray nozzle 12 of the present invention is not limited to use with backpack sprayers. To the contrary, the spray nozzle 12 of the present invention may, for example, be used with a wheeled spray device which may or may not be self-propelled or may be one of a plurality of spaced apart nozzles on, for example, a boom of such a sprayer.

In the embodiment illustrated in FIG. 1, the backpack spray device 10 generally includes a reservoir 14 for storing the liquid that will be sprayed. The reservoir 14 in this case has attached shoulder straps 16 (one of which can be seen in FIG. 1) configured for supporting the reservoir 14 on the back of a user. The fluid reservoir 14 may have other configurations depending on the application including, for example, handheld and wheeled configurations. A spray wand 18 which the operator may use to direct the liquid being sprayed is attached to the reservoir 14 via a flexible conduit 20 which is in fluid communication with the reservoir 14. The wand 18 may be equipped with an actuating device (not shown) configured to trigger discharge of the fluid in the reservoir 14. The wand 18 may also have different configurations depending on the application including, for example, being configured as a spray gun.

Figure 3:
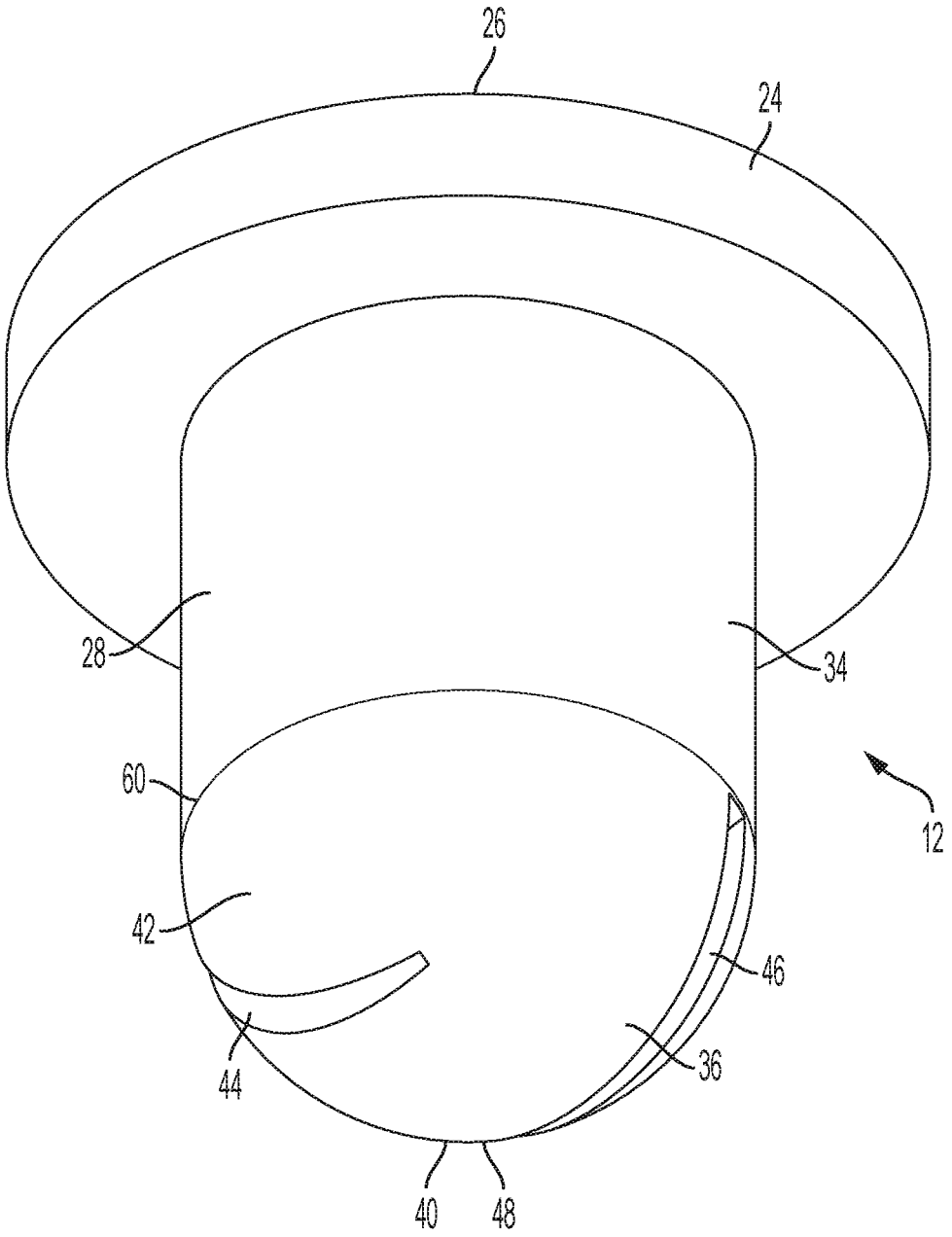
FIG. 3 is a perspective view of the spray nozzle of FIG. 2.

For discharging the liquid, a distal end of the wand 18 is equipped with a spray nozzle 12 as shown in FIG. 2. In the illustrated embodiment, the spray nozzle 12 is attached to the end of the wand 18 by a mounting nut 22 that can be received on a threaded end (not shown) of the wand 18. As shown in FIG. 3, a flange 24 may be provided at an upstream (with reference to the direction of fluid flow), inlet end 26 of the spray nozzle 12. This flange 24 may be captured at the distal end of the wand 18 by the mounting nut 22 to secure the spray nozzle 12 to the wand 18 with a body 28 of the spray nozzle 12 protruding through the central opening of the mounting nut 22.

Figure 4:
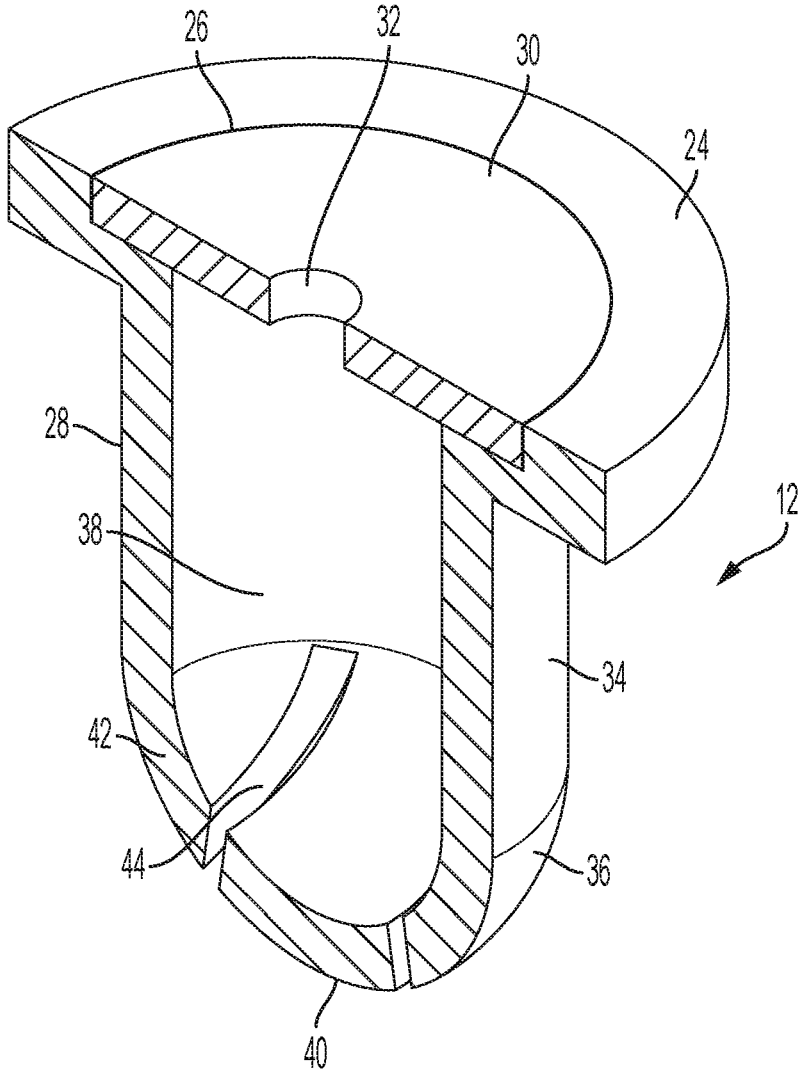
FIG. 4 is a cross-sectional, perspective view of the spray nozzle of FIG. 2.
Figure 6:
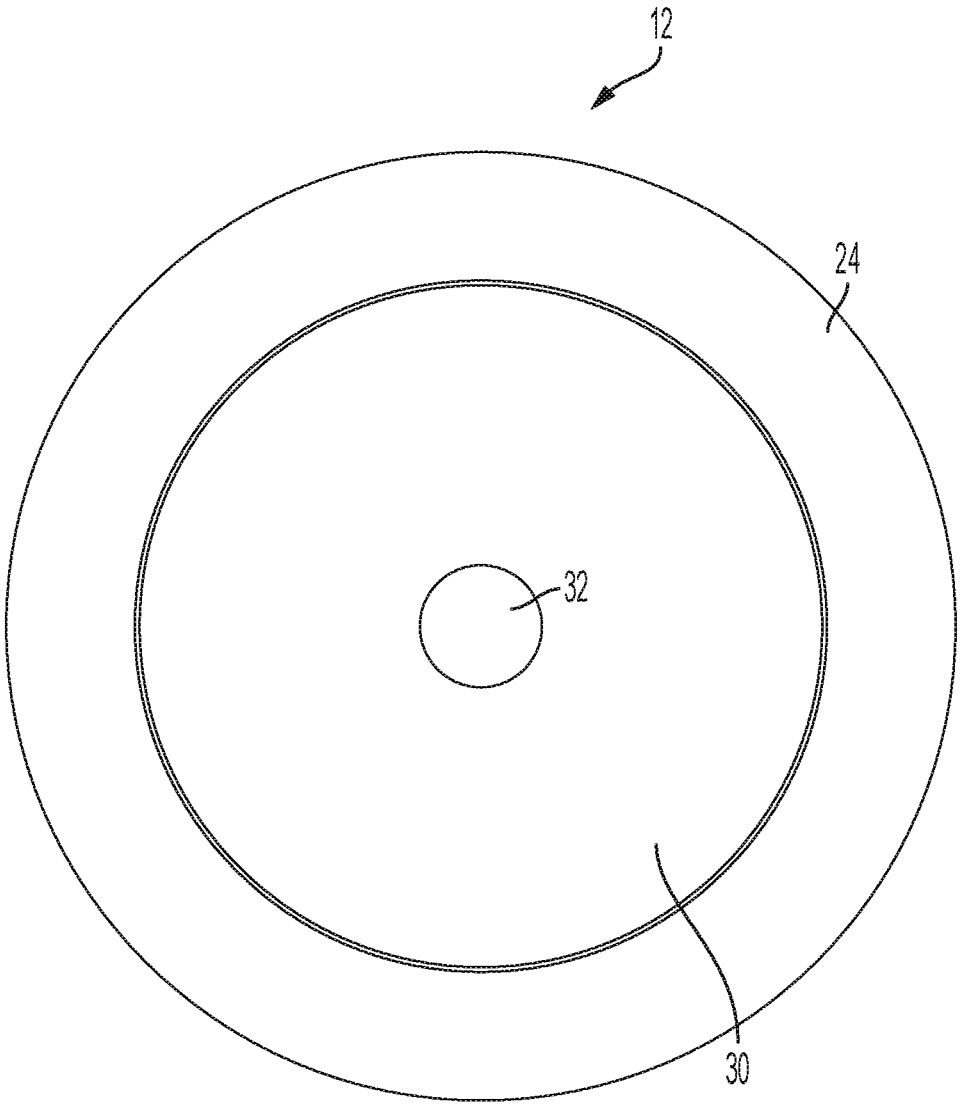
FIG. 6 is an end view of the spray nozzle of FIG. 2 showing the inlet end of the nozzle.
Figure 7:
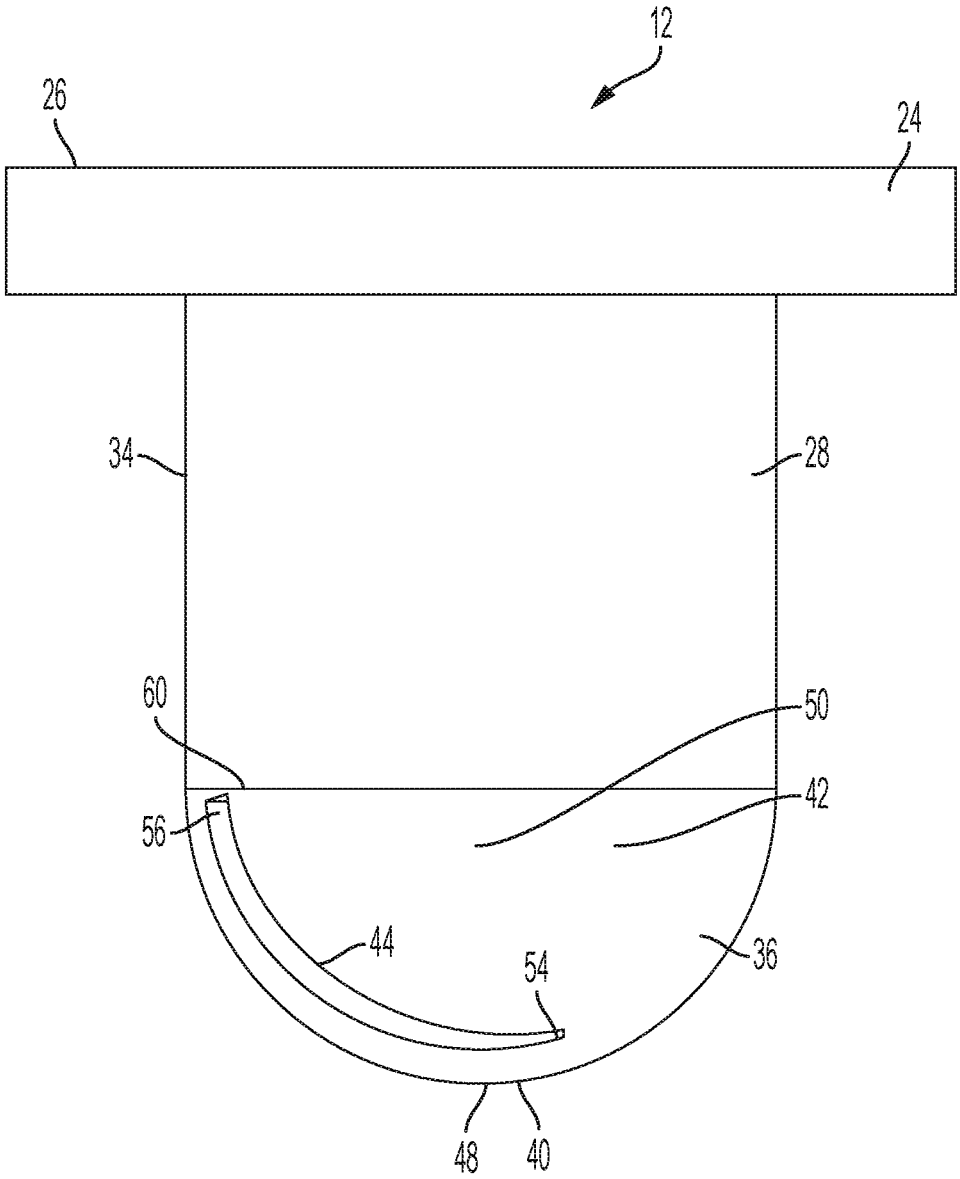
FIG. 7 is a side elevation view of the spray nozzle of FIG. 2.
Figure 8:
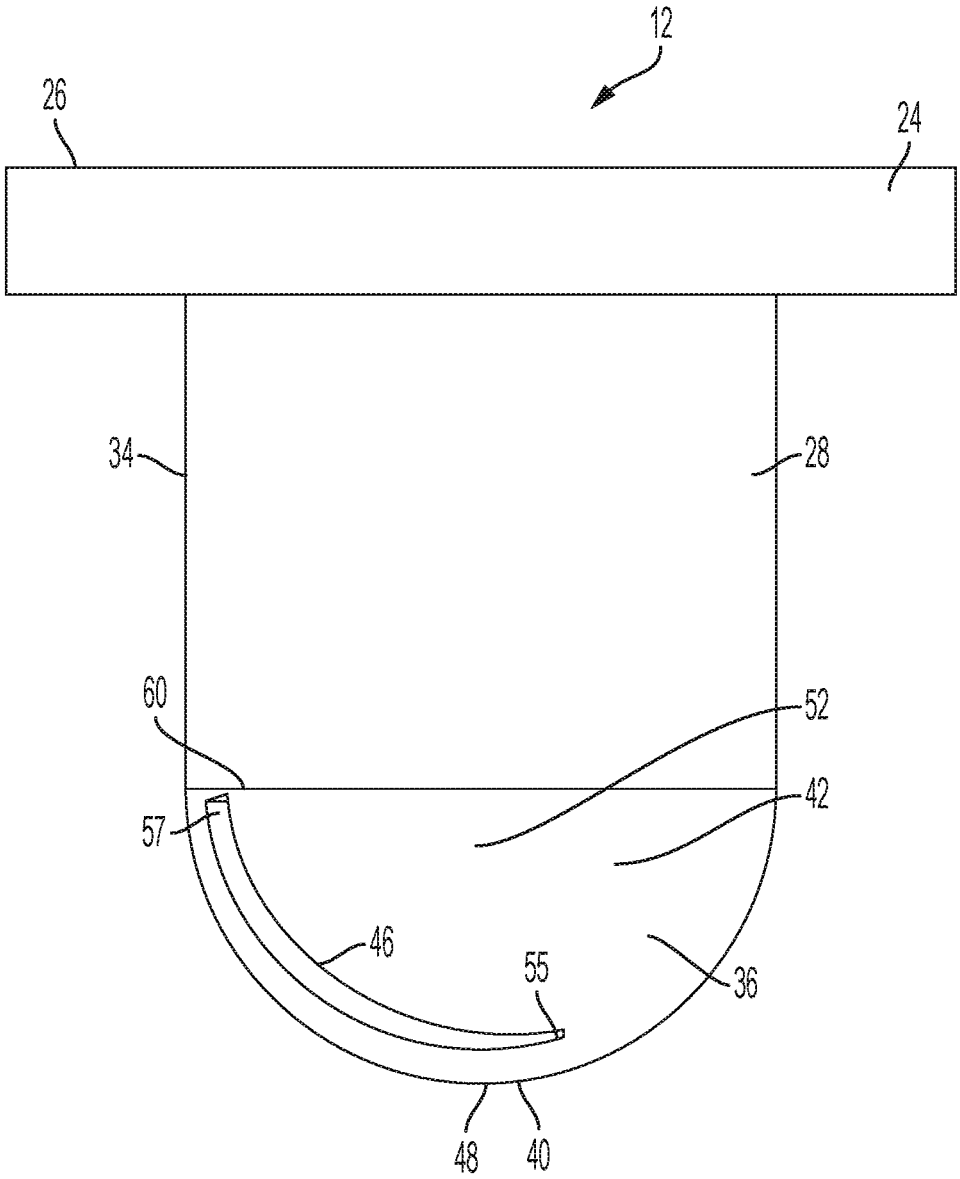
FIG. 8 is a side elevation view of the spray nozzle of FIG. 2 showing the side of the nozzle opposite the side shown in FIG. 7.

For metering the rate of flow of fluid into the spray nozzle 12, a flow control element 30 is provided at the inlet end 26 of the spray nozzle 12 as shown in FIGS. 4 and 6. In the illustrated embodiment, the flow control element 30 consists of a disc-shaped member that is received in the inlet end 26 of the spray nozzle 12. The illustrated flow control element 30 is configured as an insert that is a separate piece from the remainder of the nozzle body 28. However, in an alternative embodiment, the flow control element 30 may be integrally formed with the nozzle body 28. The flow control element 30 includes a centrally disposed pre-orifice 32 through which fluid enters the nozzle body 28. In operation, this pre-orifice 32 produces a first pressure drop of the fluid supplied from the reservoir as it enters the nozzle body 28. The size of the central pre-orifice 32 may be varied in order to provide a desired flow capacity for the spray nozzle 12.

As best shown in FIGS. 3, 4, 7 and 8, the body 28 of the spray nozzle 12 includes an upstream cylindrical portion 34 and a downstream convex portion 36. The cylindrical portion 34 and the convex portion 36 together define an internal fluid passage 38 extending from the inlet end 26 to a discharge end 40 of the spray nozzle 12 as shown in FIG. 4. The pre-orifice 32 in the flow control element 30 communicates with the internal fluid passage 38 at a downstream end thereof. The cylindrical portion 34 of the internal fluid passage 38 is configured to allow fluid to build up in the nozzle body 12. As it builds up, the fluid in the cylindrical portion 34 of the internal fluid passage 38 loses velocity. The length of the cylindrical portion 34 may be varied based on the desired flow rate for the spray nozzle with longer lengths of the cylindrical portion 34 corresponding to greater flow rates. According to one embodiment, the cylindrical portion 34 may have a length of approximately 0.35 inches. In turn, the convex portion 36, which is arranged downstream of the cylindrical portion 34 and terminates in a dome-shaped end wall 42, provides a second pressure drop for the fluid being sprayed. The convex portion 36 is also configured to provide atomization of the fluid in the spray nozzle 12. In one embodiment, the spray nozzle 12 is configured to have an operating pressure of approximately 0.75 to approximately 2.0 bar.

For producing a wide angle and even distribution pattern, two discharge orifices 44, 46 are provided in the dome-shaped end wall 42 of the convex portion 36 of the nozzle body 28. The two discharge orifices 44, 46 are offset from each other on opposite sides of the apex 48 of the dome shaped end wall 42 as shown in the end view of FIG. 5. In particular one discharge orifice 44 is arranged on a first side 50 of the end wall 42 shown in FIG. 7 while the other discharge orifice 46 is arranged on a second side 52 of the end wall 42 shown in FIG. 8. The two discharge orifices 44, 46 are identically configured, but extend in opposite, substantially parallel, directions.

Figure 5:
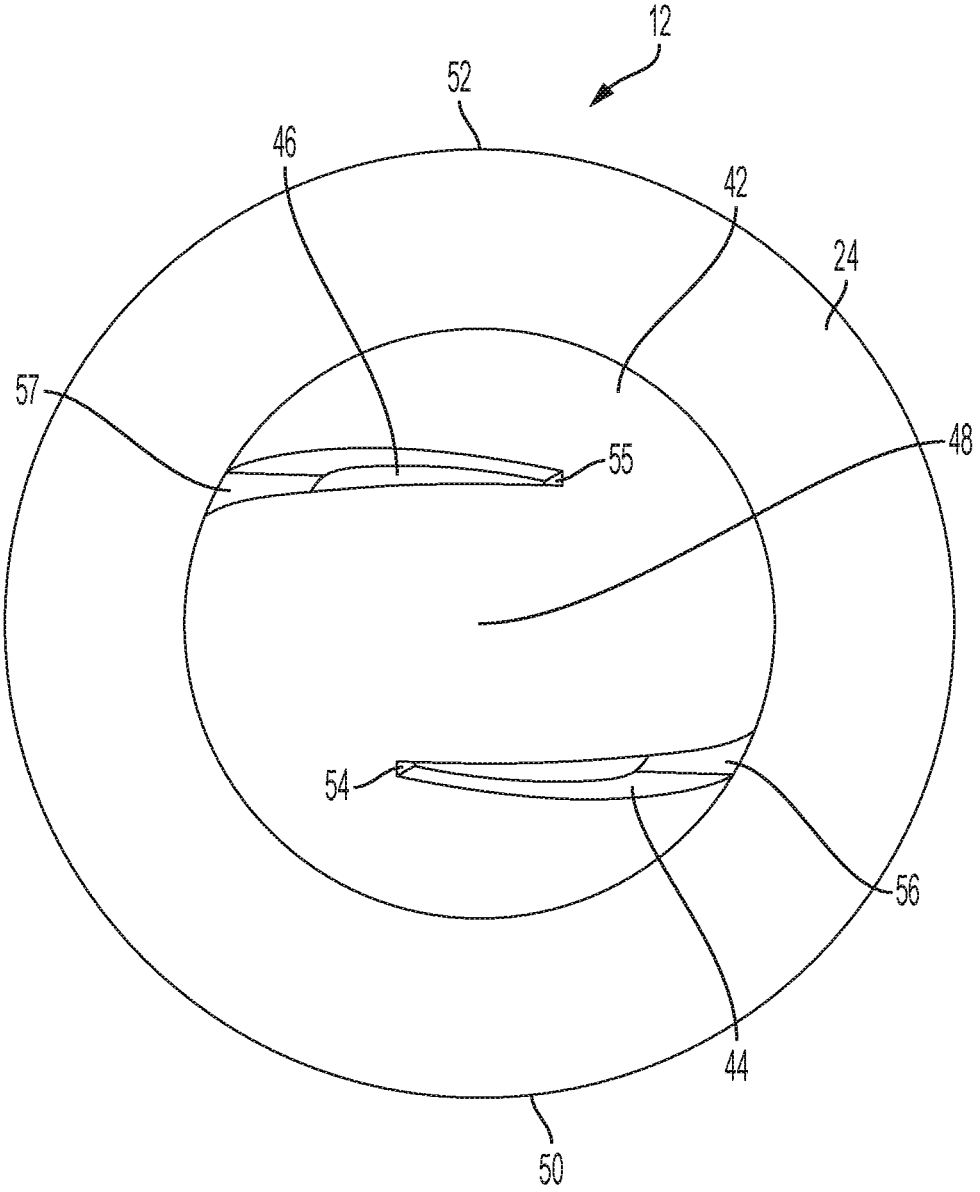
FIG. 5 is an end view of the spray nozzle of FIG. 2 showing the discharge end of the nozzle.
Figure 9:
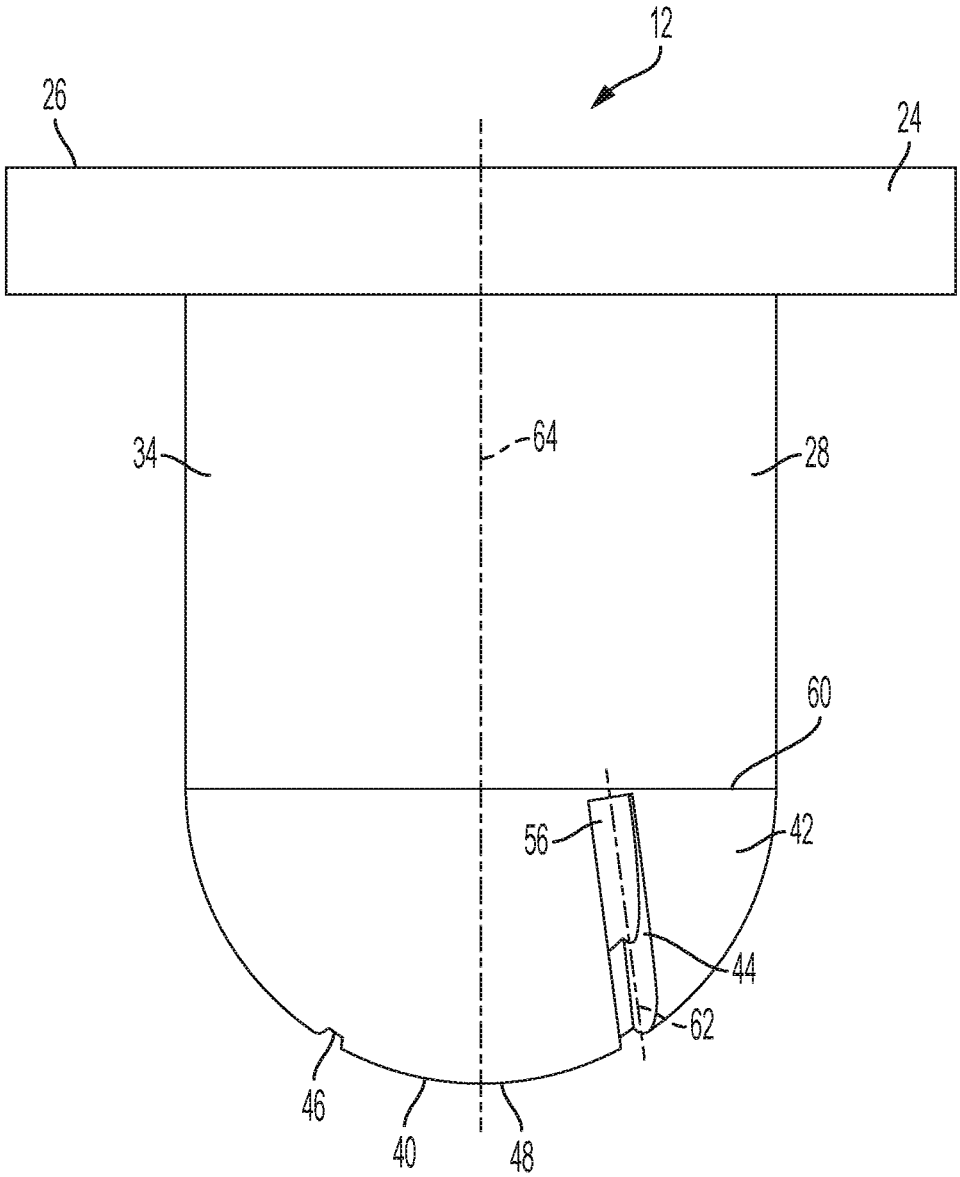
FIG. 9 is another side elevation view of the spray nozzle of FIG. 2 showing the side rotated 90° from the side shown in FIG. 7.
Figure 10:
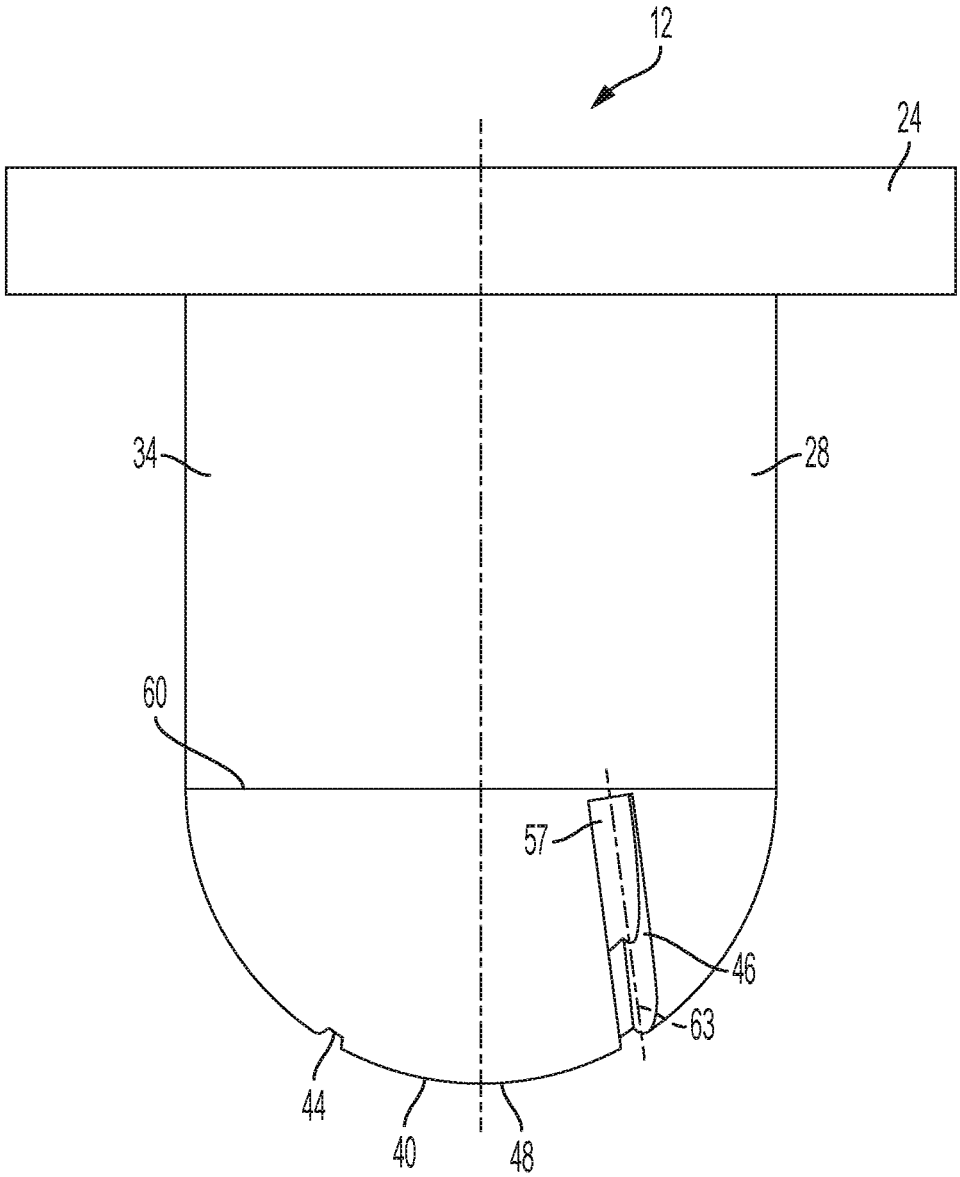
FIG. 10 is another side elevation view of the spray nozzle of FIG. 2 showing the side of the nozzle opposite the side shown in FIG. 9.

Each discharge orifice 44, 46 has an elongated slit-like configuration that widens as it extends from a first end 54, 55 to a second end 56, 57 with the edges of each orifice 44, 46 extending in an arc over the dome-shaped end wall 42. In this case, each discharge orifice 44, 46 widens continuously as it extends from the first end 54, 55 to the second end 56, 57. In the illustrated embodiment, the second end 56, 57 of each discharge orifice 44, 46 (representing the relatively wider end of the discharge orifice 44, 46) is near the transition 60 between the cylindrical portion 34 and the convex portion 36 of the nozzle body 28 (i.e., the upstream end of the convex portion). The opposing first end 54, 55 of each discharge orifice 44, 46 (representing the relatively narrower end of the discharge orifice 44, 46) is at a further downstream portion of the end wall 42 that is relative closer to the apex 48 of the end wall 42. The two discharge orifices 44, 46 each extend to a sufficient length that a substantial portion of the orifices 44, 46 overlap with one another when viewed in the first and second directions 50, 52 (represented by FIGS. 7 and 8). However, the two discharge orifices 44, 46 do not overlap along their entire length as shown in FIG. 5. Additionally, as shown in FIGS. 9 and 10, the discharge orifices 44, 46 are configured such that a straight centerline 62, 63 of each orifice 44, 46 is at an acute angle with respect to the longitudinal axis 64 of the nozzle body.

In one embodiment, the center of each discharge orifice 44, 46 at its respective base is spaced less than approximately 0.1 inches from the longitudinal axis 64 of the nozzle body 28 and more specifically approximately 0.08 inches from the longitudinal axis 64 of the nozzle body 28. In another embodiment, the centerline of each discharge orifice 44, 46 is at an angle of less than approximately 10° relative to the longitudinal axis 64 of the nozzle body 28 and more particular at an angle of approximately 7.5° relative to the longitudinal axis 64 of the nozzle body 28. In one embodiment, each discharge orifice 44, 46 is approximately 0.23 inches long when measured in a horizontal plane that extends perpendicular to the longitudinal axis 64 of the nozzle body 28. In yet another embodiment, the width of each discharge orifice 44, 46 may be approximately three times greater at the second end 56, 57 than the width at the first end 54, 55. According to one exemplary embodiment, the discharge orifices 44, 46 are approximately 0.01 inches at the first end 54, 55 and approximately 0.03 inches at the second end 56, 57. The widths of the two discharge orifices 44, 46 may be adjusted to provide a desired flow rate capacity with relatively wider orifices providing a relatively higher flow rate capacity. It should be understood that all of these dimensions are with reference to exemplary embodiments of the spray nozzle.

In operation, the two discharge orifices 44, 46 together produce an even fan-shaped spray pattern with the overlapping, relatively narrower portions of the discharge orifices producing the center of the spray pattern while the relatively wider ends of the discharge orifices produce the opposing ends of the spray pattern. The disclosed discharge orifice configuration produces a spray pattern with a relatively wide angle and an even distribution. Such a pattern can allow an operator to discharge liquid evenly over a relatively wide area simply by traversing the area in straight paths with each traverse of the area starting at the edge of spray pattern produced by the previous path.

Figure 11:
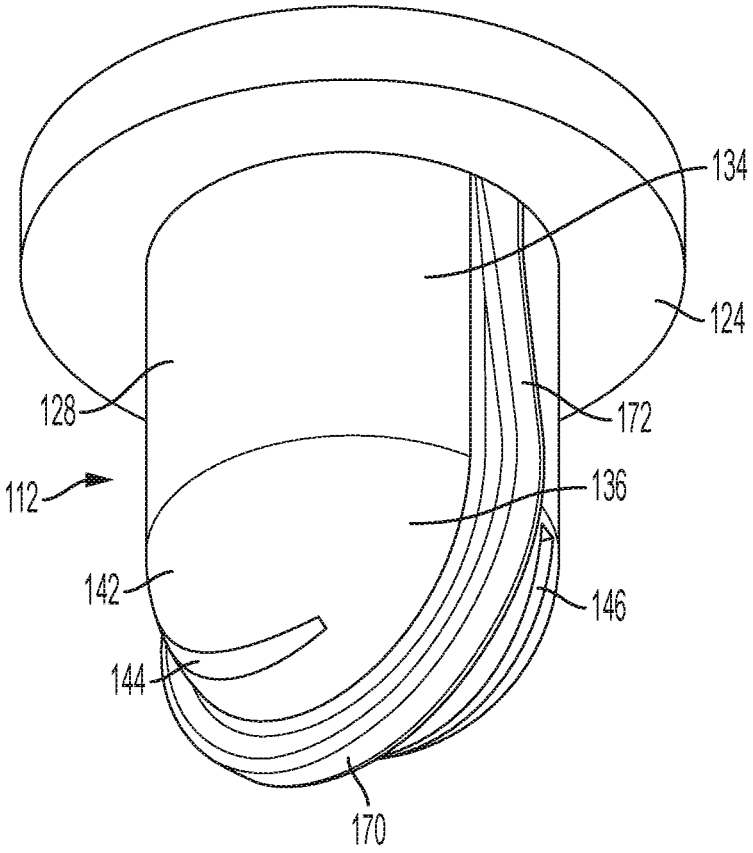
FIG. 11 is a perspective view of a further embodiment of a spray nozzle according to the present invention.
Figure 12:
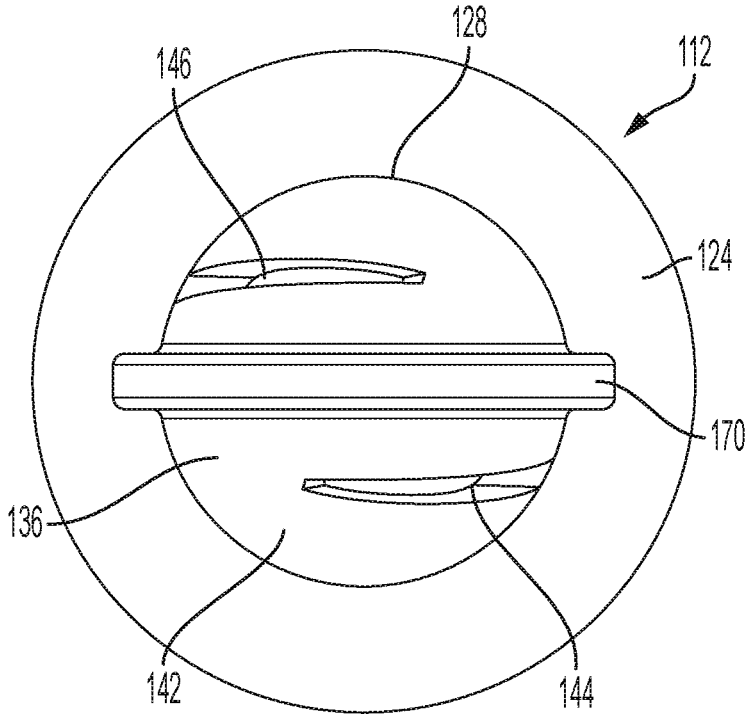
FIG. 12 is an end view of the spray nozzle of FIG. 11 showing the discharge end of the nozzle.

A further embodiment of a spray nozzle 112 according to the present invention is shown in FIGS. 11 and 12. To assist an operator in orienting the spray nozzle 112 during spraying operations, the spray nozzle 112 of FIGS. 11 and 12 is configured with an orientation feature, which in this case comprises an orientation rib 170 that extends outward from the exterior surface of the dome-shaped end wall 142 of the nozzle body 128. In the illustrated embodiment, the orientation rib 170 extends across the exterior surface of the dome-shaped end wall 142 through the apex and midway between the two discharge orifices 144 and 146. The orientation rib 170 further includes two side portions 172 each of which extends down the length of the cylindrical portion 134 of the nozzle body 128 to the flange 124. One of the side portions 172 is visible in FIG. 11 and an identical second side portion (a portion of which can be seen in FIG. 12) is spaced 180 degrees opposite the first side portion on the cylindrical portion 134 of the nozzle body 128. In this case, the side portions 172 of the orientation rib 170 each have a height that tapers as the respective side portion 172 extends down the cylindrical portion 134 from the end wall 142 towards the flange 124, although side portions 172 that do not taper in height also could be used.

In use, an operator can use the orientation rib 170 to better see how the spray nozzle 112 is oriented in the spraying device with which it is being used, such as the spray wand 18 shown in FIG. 1. The orientation rib 170 also can help inform an operator the orientation of the pattern that liquid discharging from the spray nozzle 112 will take during operation. For example, with the illustrated orientation rib 170, the long edges of the fan-shaped pattern produced by the spray nozzle 112 will be parallel to the rib 170. The orientation feature can have a configuration other than the rib 170 shown in FIGS. 11 and 12 so long as it provides an operator with a visual indication of the orientation of the spray nozzle 112 and, in particular, the orientation of the discharge orifices 144, 146 of the spray nozzle 112.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A spray nozzle for producing and directing a fan shaped spray pattern comprising:

a nozzle body having a first portion and a second portion, the first portion having a cylindrical configuration, the second portion including a dome-shaped end wall, the first and second portions of the nozzle body defining an internal fluid passage having an inlet end and a downstream end defined by the dome-shaped end wall;

a flow control element arranged at the inlet end of the internal fluid passage, the flow control element including a pre-orifice through which fluid enters the internal fluid passage of the nozzle body, loses velocity, and builds up in the cylindrical portion of the nozzle body prior to discharge from the spray nozzle; and first and second discharge orifices in the dome-shaped end wall with each of the first and second discharge orifices being arranged on a respective one of opposing first and second sides of an apex of the dome-shaped end wall; said first and second discharge orifices extending in opposite parallel directions from the apex of the dome shaped end wall; said first and second discharge orifices each having an elongated straight centerline slit-like configuration that is relatively narrower in width at a first end thereof than at a second end thereof with the first end being arranged relatively closer to the apex than the second end; a portion of the first and second discharge orifices near the first end of each discharge orifice being in overlapping relation when viewed from the first side towards the second side and said first and second discharge orifices each widen continuously as the respective discharge orifice extends from the first end to the second end; and said first and second discharge orifices being in overlapping relation less than their entire length but sufficient for producing a fan shaped fluid discharge spray pattern from the spray nozzle for direction onto a vegetation target area on the ground with even distribution with narrower overlapping portions of the discharge orifices producing a center portion of the spray pattern and relatively wider end portions of the discharge orifices producing opposing end portions of the spray pattern.

2. The spray nozzle of claim 1 wherein each of the centerlines of the first and second discharge orifices each forms an acute angle with a longitudinal axis of the nozzle body.

3. The spray nozzle of claim 2 wherein the centerline of each of the first and second discharge orifices forms an angle of less than 10 degrees with the longitudinal axis of the nozzle body.

4. The spray nozzle of claim 1 wherein each of the first and second discharge orifices is approximately three times wider at the second end than at the first end.

5. The spray nozzle of claim 1 wherein the flow control element comprises a disc-shaped member that is received in the inlet end of the nozzle body.

6. The spray nozzle of claim 1 wherein the pre-orifice is centrally disposed in the flow control element.

7. The spray nozzle of claim 1 wherein an orientation rib is provided on an exterior surface of the dome-shaped end wall, the orientation rib extending across the apex of the dome-shaped end wall midway between the first and second discharge orifices.

8. A spray device for producing and directing a fan shaped spray pattern comprising:

a fluid reservoir;

a wand attached to the reservoir by a flexible conduit which is in fluid communication with the reservoir; and a spray nozzle attached to the wand for discharging a fan shaped fluid spray from the fluid reservoir, the spray nozzle comprising:

a nozzle body having a first portion and a second portion, the first portion having a cylindrical configuration, the second portion including a dome-shaped end wall, the first and second portions of the nozzle body defining an internal fluid passage having an inlet end and a downstream end defined by the dome-shaped end wall;

a flow control element arranged at the inlet end of the internal fluid passage, the flow control element including a pre-orifice through which fluid enters the internal fluid passage of the nozzle body, loses velocity, and builds up in the cylindrical portion of the nozzle body prior to discharge from the spray nozzle; and first and second discharge orifices in the dome-shaped end wall with each of the first and second discharge orifices being arranged on a respective one of opposing first and second sides of an apex of the dome-shaped end wall; said first and second discharge orifices extend in opposite parallel directions from the apex of the dome shaped end wall; said first and second discharge orifices each having an elongated slit-like configuration that is relatively narrower in width at a first end thereof than at a second end thereof with the first end being arranged relatively closer to the apex than the second end; a portion of the first and second discharge orifices near the first end of each discharge orifice being in overlapping relation when viewed from the first side towards the second side and said first and second discharge orifices each having straight center lines and widen continuously as the respective discharge orifices extends from the first end to the second end; said first and second discharge orifices being in overlapping relation less than their entire length but sufficient for producing a fan-shaped fluid discharge spray pattern from the spray nozzle for direction onto a vegetation target area on the ground with even distribution with narrower overlapping portions of the discharge orifices producing the center portion of the spray pattern and relatively wider end portions of the discharge orifices producing opposing end portions of the spray pattern.

9. The spray device of claim 8 further including shoulder straps configured to support the reservoir on a back of a user.

10. The spray device of claim 8 wherein a flange is arranged at the inlet end of the nozzle body and further including a mounting nut for securing the spray nozzle to an end of the wand.

11. The spray device of claim 8 wherein the centerlines of the first and second discharge orifices form an acute angle with a longitudinal axis of the nozzle body.

12. The spray device of claim 11 wherein the centerlines of each of the first and second discharge orifices form an angle of less than 10 degrees with the longitudinal axis of the nozzle body.

13. The spray device of claim 8 wherein each of the first and second discharge orifices is three times wider at the second end than at the first end.

14. The spray device of claim 8 wherein the flow control element comprises a disc-shaped member that is received in the inlet end of the nozzle body.

15. The spray device of claim 8 wherein the pre-orifice is centrally disposed in the flow control element.

16. The spray device of claim 8 wherein an orientation rib is provided on an exterior surface of the dome-shaped end wall, the orientation rib extending across the apex of the dome-shaped end wall midway between the first and second discharge orifices and said first and second discharge orifices being oriented for directing fan-shaped spray patterns parallel to said orientation rib.

* * * * *